United States Patent [19]

Ciriacks et al.

[11] 4,417,211

[45] Nov. 22, 1983

[54] APPARATUS FOR DETERMINING THE ADVANCE OF A TIMING LIGHT

[75] Inventors: Patrick E. Ciriacks, Carpinteria, Calif.; Gary S. Gibson, Evanston, Ill.

[73] Assignee: Snap-on Tools Corporation, Kenosha, Wis.

[21] Appl. No.: 280,296

[22] Filed: Jul. 6, 1981

[51] Int. Cl.[3] ..... F02P 17/00

[52] U.S. Cl. ..... 324/392

[58] Field of Search ..... 324/392, 391; 73/117.2, 73/117.3, 119 R

[56] References Cited

U.S. PATENT DOCUMENTS

| | | | |
|---|---|---|---|
| 3,939,397 | 2/1976 | Maisonville | 324/392 |
| 4,010,414 | 3/1977 | Reeves et al. | 324/392 |
| 4,063,152 | 12/1977 | Reeves | 324/392 |
| 4,070,613 | 1/1978 | Brady | 324/392 |
| 4,095,170 | 6/1978 | Schmitt | 324/392 |

*Primary Examiner*—Stanley T. Krawczewicz

*Attorney, Agent, or Firm*—Dithmar, Stotland, Stratman & Levy

[57] ABSTRACT

A first pulse train is generated by a phase-locked loop circuit of which the frequency is adjustable to correspond to engine speeds of between 10 and 9,990 rpm. The pulse train is again divided to furnish a second pulse train for use in firing the timing light. A photoelectric sensor is responsive to flashes from the timing light. A D type flip-flop is coupled to the second pulse train and to the photoelectric sensor and generates an enable signal commencing with a pulse in the second pulse train and terminating with the sensor signal. A counter receives the first pulse train and is operative to count the pulses therein during the presence of the enable signal. A display depicts a number representative of the number of pulses counted by the counter.

16 Claims, 6 Drawing Figures

APPARATUS FOR DETERMINING THE ADVANCE OF A TIMING LIGHT

BACKGROUND OF THE INVENTION

It is common practice to provide in an automobile distributor, automatic means for advancing the firing point of each cylinder ahead of "top dead center", that is, the point at which a maximum amount of burning of fuel in the cylinder occurs. This automatic means causes the amount of advance, which is commonly measured in degrees, to vary in accordance with the engine speed and other engine operating parameters. A timing light measures the amount of advance at a given engine speed. It has a strobe light in the form of a gas-filled tube that is triggered by pulses corresponding to sparks for a selected cylinder. The timing light is aimed at the engine block and the adjacent rotating flywheel thereon. A timing mark on the fly wheel appears stationary because the strobe cycling matches the engine speed. To measure advance, flashing of the lamp is delayed with respect to the spark event. A knob on the device is rotatable to adjust such delay so that the flash from the strobe light occurs at top dead center. The operator can then read the knob indicia to determine the amount of advance, which is precisely equal to the delay. One such timing light is disclosed in a patent assigned to the assignee of the present application, U.S. Pat. No. 4,095,170 for "Meterless Ignition Advance Measuring Device for Internal Combustion Engines." Other timing lights have an associated meter to measure advance. Still others do not measure advance at all.

It is important that the reading on the knob or the meter, in the case of advance-measuring timing lights, be accurate, that is to say, if the meter or knob reads "45°", then there must be in fact a delay of 45°. After determining precisely the magnitude of advance the timing light can be adjusted so that the displayed value is accurate. In the case of a non-advance measuring timing light, a device for determining advance can be used to see if the advance is truly 0° (or within an acceptable range of say ±0.3°). U.S. Pat. No. 4,063,152, entitled "Method and Apparatus for Timing Light Calibration", deals with a device that determines the advance of a timing light. Such determination occurs by utilizing ignition pulses to trigger an oscilloscope. The flashes are sensed by a photoelectric sensor and applied to the vertical input of a cathode ray tube. The location of the spike on the face of the cathode ray tube indicates the amount of advance or retard between the flashes and the ignition pulses. This device has the capability of testing the timing light at only one of two engine speeds, namely, 750 rpm and 3,000 rpm. Furthermore, the patented device includes two separate elements: a console and cathode ray tube structure, making it unduly cumbersome. Finally, "eyeballing" a cathode ray tube does not yield sufficiently accurate measurements to insure the accuracy of the timing light.

SUMMARY OF THE INVENTION

It is therefore an important object of the present invention to enable determination of the advance of a timing light at any engine speed.

Another object is to reduce the size and weight of timing light calibrators and to make them self-contained.

Another object is to improve the accuracy of apparatus that determines the advance of a timing light.

In summary, there is provided apparatus for determining the advance of a timing light that produces flashes of illumination in response to firing voltage supplied by an engine being evaluated, the amount of advance between the ignition firing voltages and the flashes resulting therefrom being adjustable in accordance with a setting means and indicating means on the timing light, the combination comprising means for generating a first pulse train, means for establishing the frequency of the first pulse train at a first high value related to a selected engine speed, means for dividing the frequency of the first pulse train by a predetermined number in order to generate a second pulse train having a frequency of a second lower value, a firing circuit coupled to the dividing means and responsive to the second pulse train for producing firing voltages for the timing light, a photoelectric sensor responsinve to flashes from the timing light to produce a sensor signal, circuit means responsive to the second pulse train and the sensor signal to generate an enable signal commencing with a pulse from the dividing means and terminating with the sensor signal, a counter having a clock input coupled to the generating means and an enable input coupled to the circuit means and being operative to count pulses in the first pulse train during the presence of the enable signal, and display means coupled to the counter and being operative to depict a number representative of the pulses counted by the counter.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings, a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
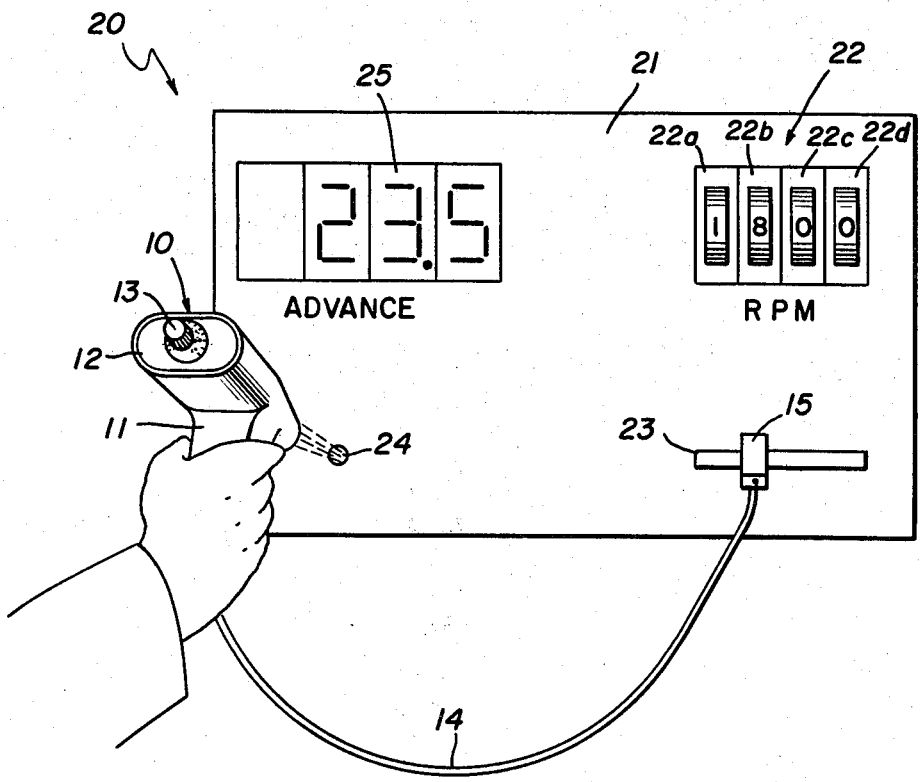
FIG. 1 depicts the front panel of an advance determining apparatus incorporating the features of the present invention, together with a timing light being calibrated thereby.

FIG. 1 depicts a timing light 10 which may be calibrated by using the present invention. The timing light 10 is generally gun shaped having a handle portion 11 and a barrel portion 12. A knob 13 is located at the rear end of the barrel portion, while the strobe or flash tube is located in the front end. Extending from the handle is a cable 14 which carries a clip 15 adapted to encircle the wire connected to a spark plug in the engine to be evaluated by the timing light. The pulses of current flowing through such wire cause the spark plug to fire and energize the timing light, causing the flash tube to flash at a rate corresponding to the speed of the engine. The operator aims the timing light 10 at the engine block, and because the flashes occur at the same speed as the engine, the timing mark on the fly wheel appears to be stationary.

The knob 13 is calibrated in degrees, and is rotated until the timing mark on the fly wheel is aligned with the timing mark on the engine block. The serviceman can determine the amount of advance (or retard) by noting the gradation on the knob 13. At 0°, the flash tube flashes at the instant a spark occurs. At a 45° advance setting, for example, the spark event takes place 45° prior to the flash of the flash tube. Engine manufacturers specify the amount of advance required for optimum engine performance. If the specification is 45°, then a mechanic analyzing engine performance with the timing light 10 will want to be sure that when the knob 13 reads 45° advance, there is precisely 45° advance between the spark event and top dead center.

There are other timing lights the accuracy of which must be determined. For example, there are timing lights that instead of utilizing an indicia-bearing knob, use a meter to display the amount of advance. Still others have no advance-measuring capability; or stated another way, the amount of advance would be 0°. In these types of timing lights too, whether the amount of advance is read on a meter or is 0° in the non-advance timing lights, a determination of the amount of advance is important.

To calibrate any such timing light, there is provided advance determining apparatus 20 which has a front panel 21. Mounted on the panel 21 is a speed control 22 consisting of a set of adjustable thumb wheels 22*a*, 22*b* and 22*c* and a fixed thumb wheel 22*d* set at "0". The thumb wheels 22*a–c* can be set so that the engine speed is at a value between 10 and 9990 rpm, at 10 rpm increments.

Also mounted on the front panel 21 is an inductive pickup bar 23 to which the clip 15 of the timing light 10 may be coupled. The apparatus 20 includes a photoelectric sensor 24 to which flashes from the timing light 10 are directed. The apparatus 20 also includes a digital display 25 which for purposes of illustration depicts the number "23.5". The display 25 depicts the magnitude of advance between the occurrence of an inductive pulse on the bar 23 and the production of a flash by the timing light 10. The calibration is performed at a selected speed by setting the speed control 22 to the desired value. The knob 13 is rotated to a predetermined advance setting such as 45°. If the display 25 does not depict the number "45.0", a potentiometer or the like in the timing light 10 is adjusted until it does. To determine if the advance readings of the timing light 10 is within specified tolerances at other speeds, the speed control 22 may be adjusted to each speed and noting the amount of advance on the display 25. Although normally an advance of 60.0° or less is all that is needed, the present invention provides readings up to 720°.

Figure 2:
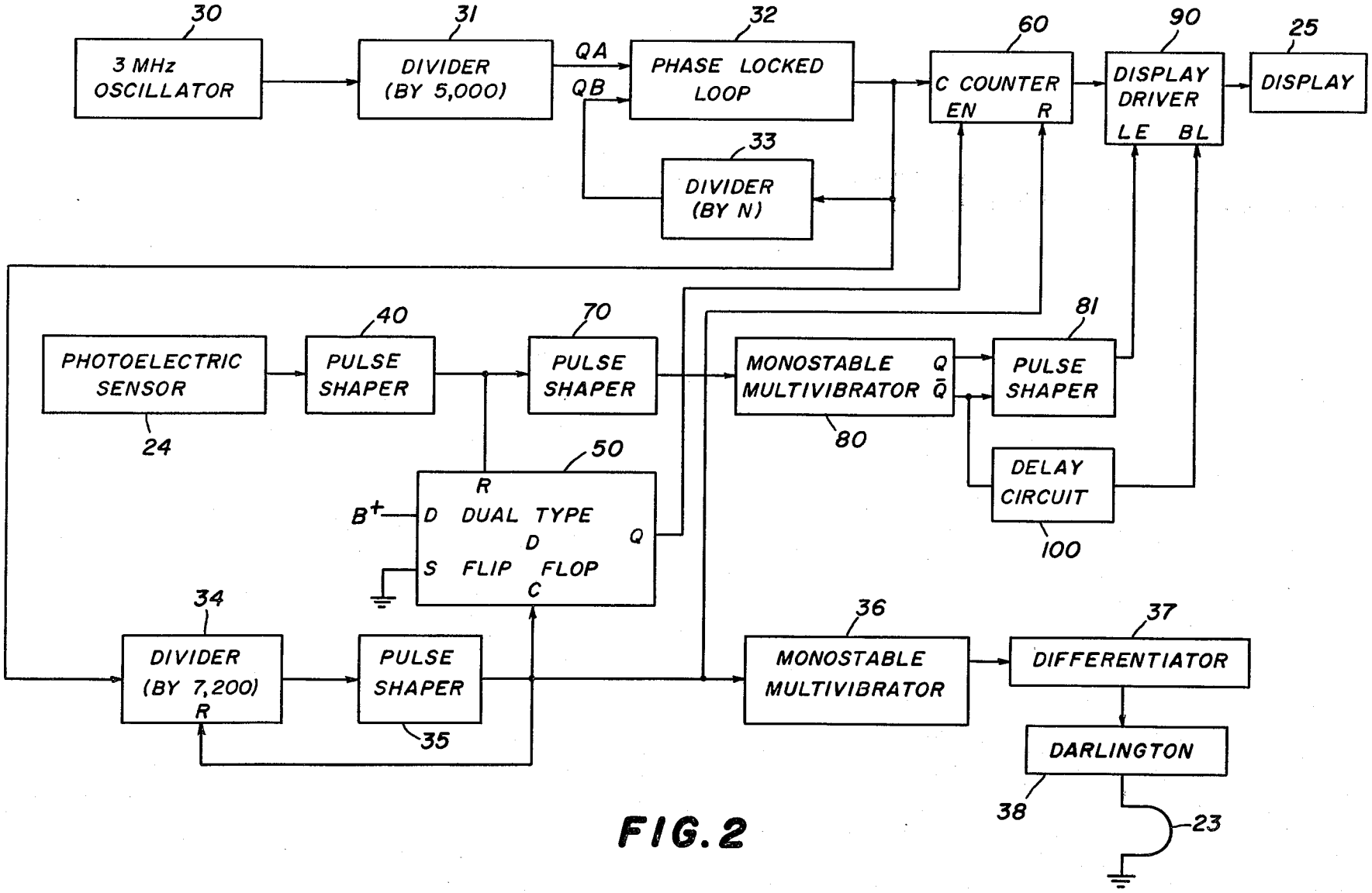
FIG. 2 is a block diagram of the circuitry in the advance determining apparatus.

Turning now to FIG. 2, the advance determining apparatus 20 comprises a 3 MHz oscillator 30, preferably crystal controlled, and a divider circuit 31 which divides the 3 MHz signal by 5,000 to provide a 600 Hz oscillator signal. Such numbers are of course exemplary. The oscillator signal is coupled to the phase A input of a phase-locked loop device 32, the output of which is fed back through a divider circuit 33 to the phase B input of the device 32. The divider circuit 33 divides by N the frequency of the pulse train produced by the device 32, whereby such frequency is 600 times N. In an actual embodiment, the device 32 was made by Motorola, Inc. under its model No. MC14046B. N is equal to the setting of the speed control 22 divided by 10, and has a value of between 1 and 1,000 so that the frequency of the pulse train produced by the phase-locked loop device 32 will be between 600 Hz and 600 KHz. If a speed of 1,800 rpm is programmed into the speed control 22, N would be 180 and the frequency of the pulse train produced by the phase-locked loop device 32 would be 108 KHz (600×180).

The first pulse train is applied to a second divider 34 providing a fixed divisor, here 7,200. The value of the divisor is selected such that the output of the divider 34 is a train of inductive pulses at a frequency corresponding to the frequency of the spark events at a selected engine speed. The divisor 7,200 is derived in the following manner. The divisor is equal to the frequency of the first pulse train (600 N) divided by the rate of pulses from the divider 34. That pulse rate is in turn equal to the engine speed (ES) divided by 120 (since there are 60 seconds in one minute and 2 engine rotations for each pulse). Finally, N equals the engine speed divided by 10. Substituting, the divisor equals $600\times(ES/10)\div(ES/120)$, or 7,200.

A pulse shaper 35 increases the duration of each pulse somewhat. The pulses are applied to the reset input of the divider 34 so as to reset it each time it produces a pulse. The pulse train is also applied to a monostable multivibrator 36 which further conditions the pulses and increases their duration. In an operative embodiment, the pulses from the multivibrator 36 had a duration of about 1 ms. Differentiator 37 differentiates the pulses to achieve sharp rising edges and exponentially decaying trailing edges. This insures that there is only one per rapid change in current per inductive pulse. A Darlington pair 38 is driven by these pulses, which in turn supplies current to the inductive pickup bar 23. The timing light 10 when connected to the bar 23 will flash in accordance with the rate of pulses produced by the divider circuit 34. The circuits 35–38 and the bar 23 may, therefore, be considered a firing circuit responsive to the pulse train from the divider 34 for producing firing voltages from the timing light.

Light from the timing light is directed to the photoelectric sensor 24 as previously described. It produces a sensor pulse which is shaped in a pulse shaper 40 and applied to the reset input R of a dual type D flip-flop 50 which may be of the type produced by Motorola, Inc. under its model No. MC14013B. The data input D is coupled to the B+ supply voltage and the set inputs are coupled to ground. The clock input C is coupled to the pulse shaper 35 so as to receive the pulse train therefrom. When so connected, a positive transition on the clock input C while the reset input R is low will cause the Q output to become high. A negative transition on the clock input while the reset input is low will cause no change in the Q output. If the reset input is high, the Q output will be low irrespective of the signal applied to the clock input. Throughout this application reference is made to inputs and outputs becoming "high" and "low". These, of course, are exemplary and the same results can be obtained by reversing the logic.

Figure 3:
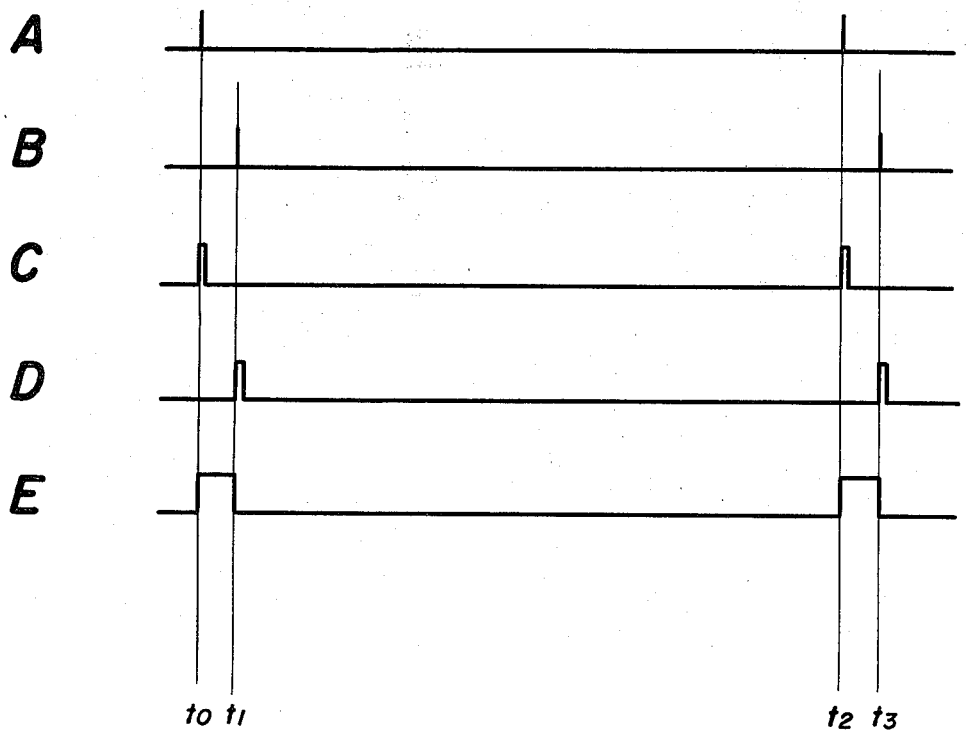
FIG. 3 is a timing diagram for use in explaining the operation of the advance determining apparatus.

Reference is made to FIG. 3 which depicts pertinent waveforms. FIG. 3A depicts the pulses from the divider 34 and FIG. 3C depicts the pulses from the pulse shaper 35 which are applied to the clock input of the dual type D flip-flop 50. The pulses generated by the photoelectric sensor 24 in response to the flashing timing light is shown in FIG. 3B and the train of pulses developed by the pulse shaper 40 and applied to the reset input of the flip-flop is depicted in FIG. 3D. FIG. 3E depicts the resultant signal on the Q output. Prior to $t_0$, the Q output is zero. At $t_0$, the clock input becomes high as a result of an inductive pulse. That transition, while the reset input is low, causes the Q outut to become high, as shown in FIG. 3E.

At the end of the inductive pulse its negative transition has no effect on the Q output while a reset input remains low. At time $t_1$, the reset input becomes high as the result of a flash from the timing light. As a result, the Q output becomes low and remains low until the next inductive pulse at $t_2$. At that time, the Q output again becomes high in the same manner until $t_3$ at which time it becomes low again. Thus, the dual type D flip-flop generates on the Q output an enable signal commencing at $t_0$ with an inductive pulse from the pulse shaper 35 and terminating at $t_1$ with a sensor signal from the pulse shaper 40.

The Q output of the flip-flop 50 is coupled to the enable input of a counter 60, the reset input of which is coupled to the output of the pulse shaper 35 and the clock input C which is coupled to the phase-locked loop device 32. Thus, the counter 60 has applied to it the high frequency pulse train at a frequency of 600 N and is operative to count those pulses during the presence of the enable signal from the flip-flop 50 which in the example of FIG. 3 occurs during $t_0$–$t_1$ and $t_2$–$t_3$.

The sensor pulses are further shaped in a pulse shaper 70 and applied to a timer circuit 80 which is a monostable multivibrator having a predetermined time constant such as 0.4 second. The multivibrator 80 is non-retriggerable; that is, once it is triggered by a shaped sensor pulse, it will be in its unstable condition for the time-out period, irrespective of the occurrence of sensor pulses at a much more rapid rate. Each sensor pulse will cause the Q output of the multivibrator 80 to become high and stay high for the time-out period, such output being a timer signal. The $\overline{Q}$ output becomes low for the same period, and, therefore, there appears thereon an inverted timer signal. Both timer signals are applied to a pulse shaper 81 which produces a pulse commencing essentially at the same time as the occurrence of a flash. This pulse is applied to the LE (latch enable) input of a display driver 90. The output of the counter 60 is applied to the display driver 90 the output of which is in turn applied to the display 25.

Thus, there will be produced a short pulse of a few microseconds every half second or so assuming that is the time-out period of the multivibrator 80. During the occurrence of that pulse, the display driver 90 will apply to the display 25 signals corresponding to the number of pulses counted by the counter 60 during the just completed enable signal. After termination of the pulse from the pulse shaper 81, the display driver 90 continues to apply the same information to the display 25. After the time-out period has lapsed, the multivibrator 80 reverts to its stable state. The next sensor pulse created as the result of the next flash will cause the multivibrator 80 again to revert to its unstable state for the time-out period. The pulse shaper 81 will produce a short release pulse to the control or LE input of the display driver 90 causing the information counted by the counter 60 during the latest enable signal to be released to the display 25. Thus, information depicted on the display 25 is updated according to the time-out rate of the multivibrator 80.

The display 25 will depict digitally a number corresponding to the number of pulses counted by the counter 60 during the previous enable period which in turn represents the time between an inductive pulse and the corresponding flash by the timing light. The relationship of the frequency of the output of the phase-locked loop device 32 (600 N) and the frequency of the divider 34 (7,200) causes the number depicted by the display 25 to represent the number of degrees of advance (or retard) between the inductive pulse and the corresponding flash.

The $\overline{Q}$ output of the monostable multivibrator 80 is coupled to a delay circuit 100, the output of which is coupled to the blanking input of the display driver 90. As long as the blanking input is low, the display 25 will be blank. As previously mentioned, a flash causes the $\overline{Q}$ output to become low and stay low for the time-out period. After a predetermined delay, the output of the delay circuit 100 becomes low. If the time between flashes is less than the delay furnished by the delay circuit 100, the BL input will not become low. If the timing light is turned off after the delay period has lapsed, the BL input becomes low and the display 25 becomes blank. A time of one second between flashes corresponds to an engine speed of 120 rpm (60 seconds per minute×2 revolutions per flash divided by one second). Thus, if the engine speed setting is less than 120 rpm, the display will be blank for a period each cycle. This will result in a flashing effect which increases as the engine speed decreases. The flashing effect can be eliminated by increasing the amount of delay furnished by the delay circuit 100.

Figure 4:
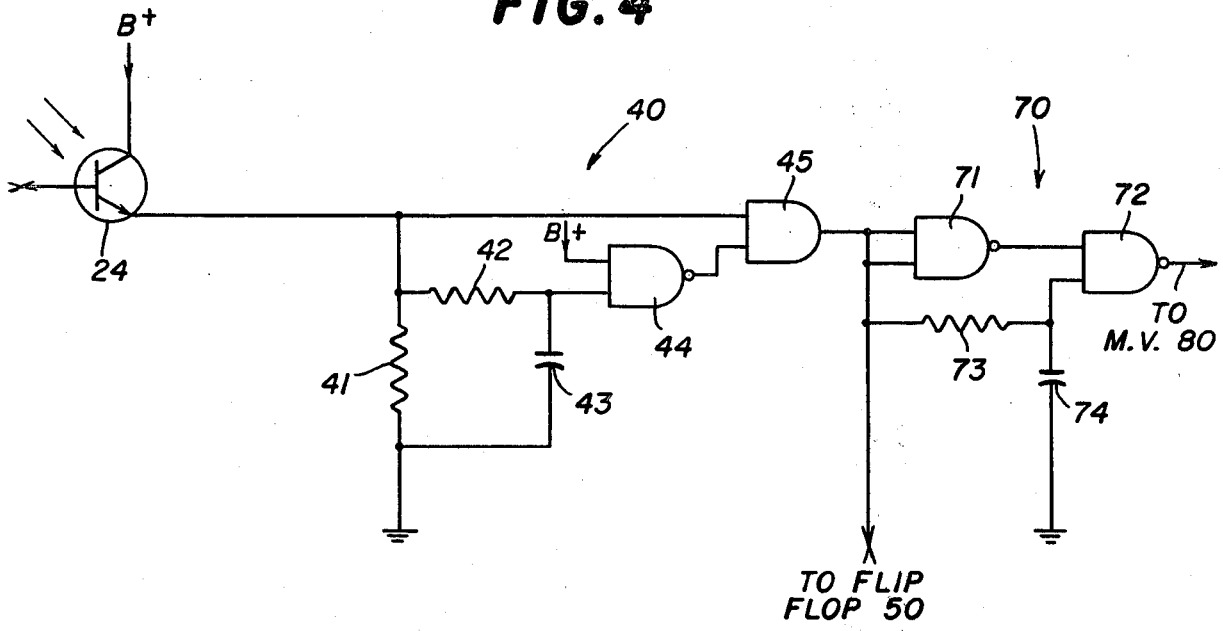
FIG. 4 is a logic and schematic diagram of the photoelectric sensor and associated pulse shaper circuitry.

Turning now to FIG. 4, details of the photoelectric sensor 24, the pulse shaper 40 and the pulse shaper 70 will be described. The photoelectric sensor 24 is a light sensitive PNP transistor with its base open. It may be of a type sold under model No. 2N5777. The pulse shaper 40 includes a resistor 41 to ground and a resistor 42 and a capacitor 43 coupled in series from the emitter of the transistor 24 to ground. The junction of the resistor 42 and the capacitor 43 is coupled to a NAND gate 44 connected as an inverter, the output of which is coupled to an AND gate 45. The other input of the AND gate 45 is connected directly to the photoelectric sensor 24. The resistor 42 and the capacitor 43 cause the inverted signal applied to one input to be delayed with respect to the signal applied to the other input. Thus, both inputs to the AND gate 45 will be high for a time starting with the flash sensed by the photoelectric sensor 24 and ending at a time later determined by the values of the resistor 42 and the capacitor 43. In one embodiment, the resistor 42 had a value of 20K and the capacitor had a value of 0.001 microfarad so that the duration of the pulse produced by the AND gate 45 was about 16 microseconds.

This pulse is applied to the dual type D flip-flop 50 as previously described. It is also applied to a second pulse shaper 70 which has a NAND gate 71 connected as an inverter having its output coupled to one input of a second NAND gate 72. Its other input is coupled to the junction of a resistor 73 and a capacitor 74 coupled in series to ground. Thus, applied to the top input of the NAND gate 72 is an inverted version of the pulse from the gate 45 and applied to its other input is a non-inverted but delayed version of that pulse. The NAND gate 72 will provide a negative going pulse commencing with the flash and terminating at a time determined by the values of the resistor 73 and the capacitor 74. In an actual embodiment, the resistor 73 had a value of 1K and the capacitor 74 had a value of 160 picofarads so that the duration of the pulse from the NAND gate 72 was about 0.44 microsecond.

Figure 5:
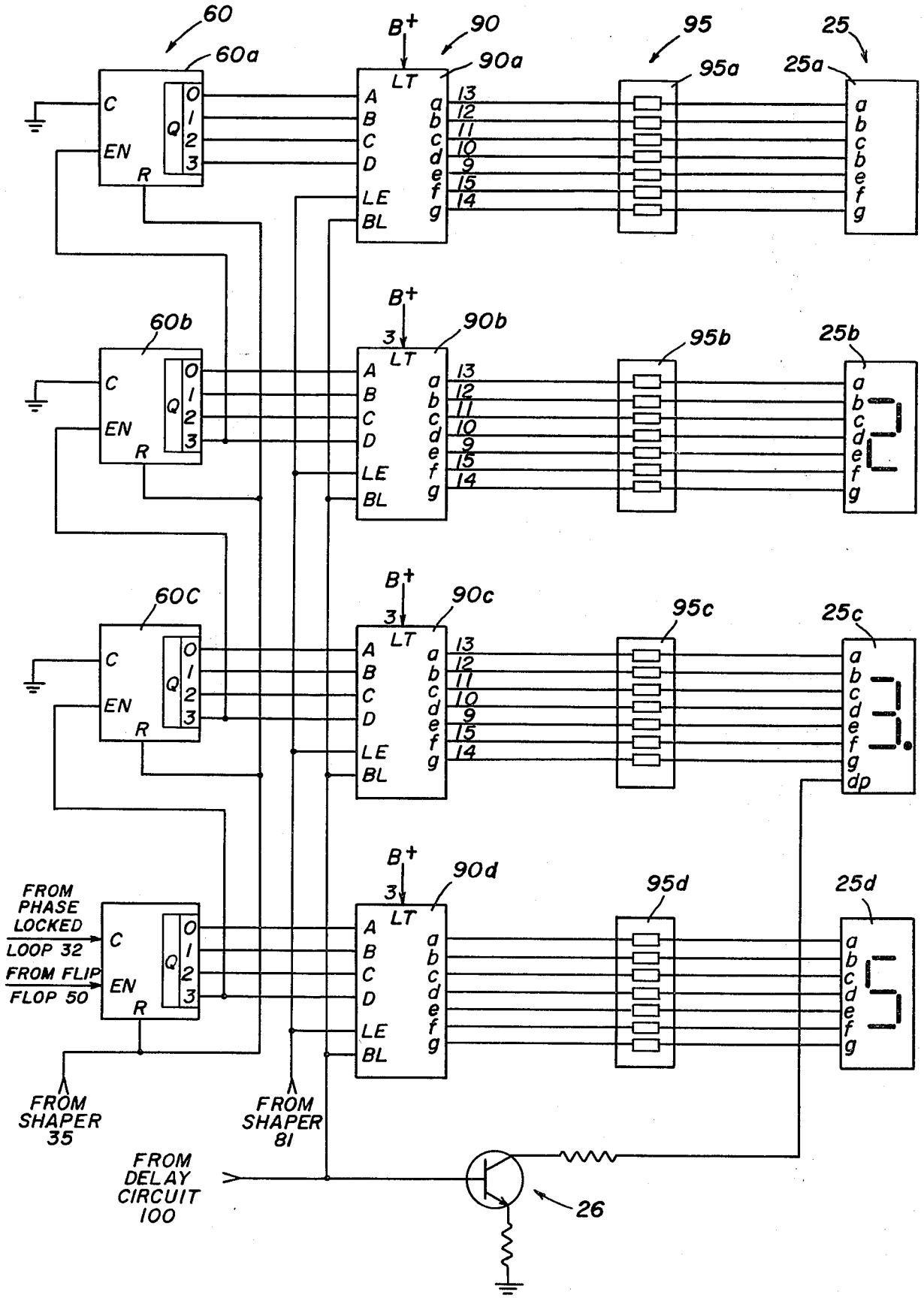
FIG. 5 is a block diagram of the counters, display drivers and displays of FIG. 2.

The details of the counter 60, the display driver 90 and the display 25 are depicted in FIG. 5. Actually, the counter 60 is constructed of four separate counters 60*a*, 60*b*, 60*c* and 60*d* connected in series. The Q3 output of the counter 60*d* is connected to the enable input of the counter 60*c*, the Q3 output of the counter 60*c* is connected to the enable input of the counter 60*b*, and so forth. The enable input of the counter 60*d* is connected to the dual type D flip-flop 50. The reset inputs are connected together and to the pulse shaper 35. The clock inputs of the counters 60*a*, 60*b* and 60*c* are connected to ground while the clock input of the counter 60*d* is connected to the phase-locked loop device 32. In an actual embodiment, each of the counters 60*a–d* was a Motorola, Inc. device, model No. MC14518B.

The display driver 90 actually consists of four drivers 90*a*, 90*b*, 90*c* and 90*d*, each having its signal inputs A, B, C, and D connected to the Q outputs of the counters 60*a–d*, respectively. The latch enable inputs are connected together and to the pulse shaper 81. The four blanking inputs are connected together and to the delay circuit 100. In an actual embodiment, each of the drivers 90*a–b* was a Motorola, Inc. device, model No. MC14511B. The outputs of the drivers 90*a–d* are coupled through 470 ohm resistors 95 to the display 25 which consists of four individual displays 25*a*, 25*b*, 25*c*, and 25*d*. The decimal point on the display 25*c* is connected through a transistor circuit 26 to the line to which the blanking inputs of the drivers 90*a–d* are connected. Thus, as long as the display 25 is unblanked, the decimal point is illuminated. When the display is blank, the decimal point is blanked also. Usually, advance is no more than 60.0° which requires only three displays. However, the apparatus 20 is capable of evaluating advance from 0° to 720.0° and therefore there are four displays 25*a–d*.

Figure 6:
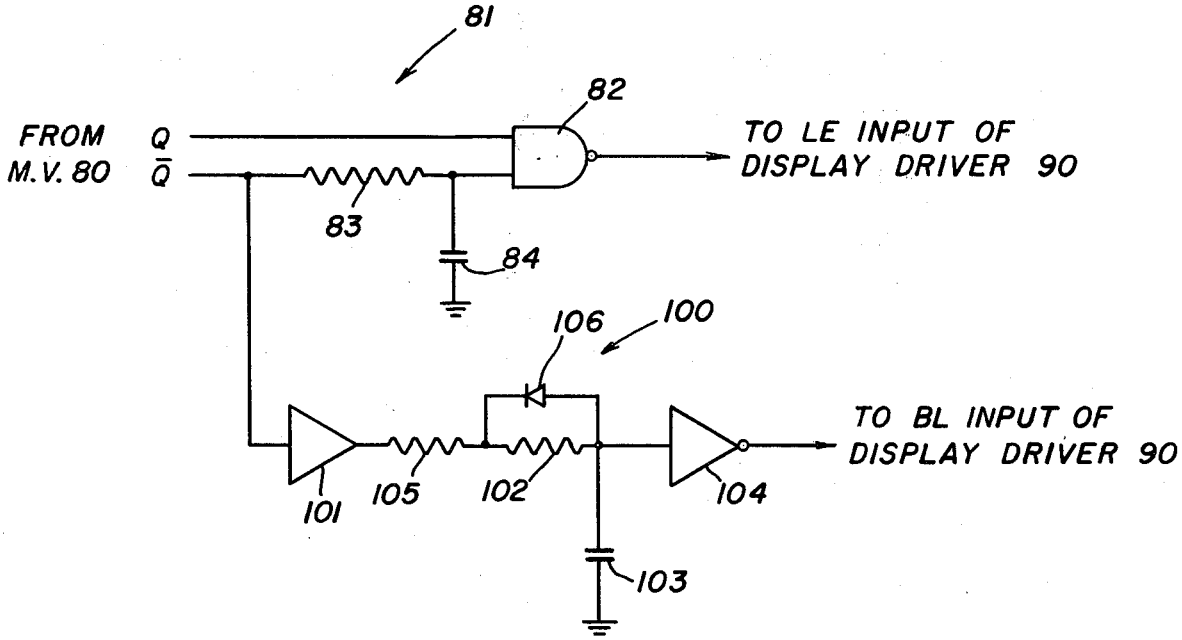
FIG. 6 is a logic and schematic diagram of the delay circuit and another pulse shaper circuit depicted in FIG. 2.

Details of the pulse shaper 81 and the delay circuit 100 are depicted in FIG. 6. The Q output of the multivibrator 80 is coupled directly to one input of a NAND gate 82, the other input of which is coupled to the junction of a resistor 83 and a capacitor 84 connected in series from the Q output of the multivibrator 80 to ground. The positive going time signal applied to one input of the NAND gate 82 and the negative going timer signal delayed by the value of the resistor 83 and the capacitor 84 causes the NAND gate 82 to produce a negative going release pulse for the LE input of the display driver 90. In an operative embodiment, the resistor 83 had a value of 10K and the capacitor 84 had a value of 10 picofarads so that the duration of the release pulse was about 1 microsecond.

The timer signal on the $\overline{Q}$ output is also applied to a buffer 101 which is delayed by resistors 102 and 105 and a capacitor 103 coupled in series to ground, the junction of which is coupled to an inverter 104. A diode 106 is coupled across the resistor 102. The output is coupled to the display driver 90. Thus, the timer signal is delayed by an amount corresponding to the values of the resistors 102 and 105 and the capacitor 103 and inverted before being applied to the blanking input of the display driver 90. The diode 106 and the resistors 102 and 105 prevent the capacitor 103 from discharging for such an extended period blank to display unnecessarily. In an actual embodiment, the resistor 102 had a value of 500K and the capacitor 103 had a value of 2.2 microfarads, so that the delay was about 0.87 second.

What has been described therefore is a unique apparatus for determining the advance of a timing light at any engine speed from 10 rpm to 9,990 rpm with the examples given. By simply changing the range of N, the rpm settings can be expanded to whatever is desired. Furthermore, any advance of between 0° and 720°, at 0.1° increments, can be determined. When the timing light is calibrated at one engine speed, it is very simple to determine what the advance is at any other engine speeds for purposes of quality control. The advance determining apparatus 20 is compact, being contained in a single, rather small housing. It is highly accurate, giving information on advance to the nearest 0.1 degree.

We claim:

1. Apparatus for determining the advance of a timing light that produces flashes of illumination in response to ignition firing voltage supplied by an engine being evaluated, the amount of advance between the firing voltages and the flashes resulting therefrom being adjustable in accordance with a setting means and indicating means on the timing light, the combination comprising means for generating a first pulse train, means for establishing the frequency of the first pulse train at a first high value related to a selected engine speed, means for dividing the frequency of the first pulse train by a predetermined number in order to generate a second pulse train having a frequency of a second lower value, a firing circuit coupled to said dividing means and responsive to the second pulse train for producing firing voltages for the timing light, a photoelectric sensor responsive to flashes from the timing light to produce a sensor signal, circuit means responsive to the second pulse train and the sensor signal to generate an enable signal commencing with a pulse from said dividing means and terminating with said sensor signal, a counter having a clock input coupled to said generating means and an enable input coupled to said circuit means and being operative to count pulses in the first pulse train during the presence of the enable signal, and display means coupled to said counter and being operative to depict a number representative of the pulses counted by the counter.

2. The advance determining apparatus of claim 1, wherein said predetermined number is 7,200 and the second lower value is between 1/12 Hz. and 1/12 KHz.

3. The advance determining apparatus of claim 1, wherein said firing circuit includes a Darlington pair and an inductive pickup.

4. The advance determining apparatus of claim 1, wherein said firing circuit includes a differentiator for differentiating the pulses in said second pulse train.

5. The advance determining apparatus of claim 1, and further comprising means for shaping the sensor signal before application to said circuit means.

6. The advance determining apparatus of claim 1, wherein said circuit means is a dual-type D flip-flop having a D input coupled to a supply voltage, an R input coupled to said photoelectric sensor, a C input coupled to said dividing means, and an output providing the enable signal.

7. The advance determining apparatus of claim 1, wherein said dividing means has a reset input coupled to receive the second pulse train.

8. The advance determining apparatus of claim 1, wherein said counter has a reset input coupled to receive the second pulse train.

9. The advance determining apparatus of claim 1, wherein all of the elements of said combination are in a single housing.

10. Apparatus for determining the advance of a timing light that produces flashes of illumination in response to ignition firing voltage supplied by an engine being evaluated, the amount of advance between the firing voltages and the flashes resulting therefrom being adjustable in accordance with a setting means and indicating means on the timing light, the combination comprising a phase-locked loop having first and second inputs and an output, an oscillator for producing an oscillator signal coupled to said first input, a divide-by-N circuit coupled from said output to said second input, whereby a first pulse train is produced on said output having a frequency of N times the frequency of the oscillator signal, N being related to a selected engine speed, means for dividing the frequency of the first pulse train by a predetermined number in order to generate a second pulse train having a frequency of a second lower value, a firing circuit coupled to said dividing means and responsive to the second pulse train for producing firing voltages for the timing light, a photoelectric sensor responsive to flashes from the timing light to produce a sensor signal, circuit means responsive to the second pulse train and the sensor signal to generate an enable signal commencing with a pulse from said dividing means and terminating with said sensor signal, a counter having a clock input coupled to said generating means and an enable input coupled to said circuit means and being operative to count pulses in the first pulse train during the presence of the enable signal, and display means coupled to said counter and being operative to depict a number representative of the pulses counted by the counter.

11. The advance determining apparatus of claim 10, wherein the frequency of said oscillator signal is on the order of 600 Hz.

12. The advance determining apparatus of claim 10, wherein N is between 1 and 1,000.

13. Apparatus for determining the advance of a timing light that produces flashes of illumination in response to ignition firing voltage supplied by an engine being evaluated, the amount of advance between the firing voltages and the flashes resulting therefrom being adjustable in accordance with a setting means and indicating means on the timing light, the combination comprising means for generating a first pulse train, means for establishing the frequency of the first pulse train at a first high value related to a selected engine speed, means for dividing the frequency of the first pulse train by a predetermined number in order to generate a second pulse train having a frequency of a second lower value, a firing circuit coupled to said dividing means and responsive to the second pulse train for producing firing voltages for the timing light, a photoelectric sensor responsive to flashes from the timing light to produce a sensor signal, circuit means responsive to the second pulse train and the sensor signal to generate an enable signal commencing with a pulse from said dividing means and terminating with said sensor signal, a counter having a clock input coupled to said generating means and an enable input coupled to said circuit means and being operative to count pulses in the first pulse train during the presence of the enable signal, a display driver coupled to said counter and being operative to provide a number representative of the number of pulses counted by the counter, and digital display means coupled to said display driver and being operative to depict a number corresponding to the number accepted by said display driver.

14. The advance determining apparatus of claim 13 and further comprising control means responsive to the sensor signal to generate a release signal upon the occurrence of the first flash and release signals thereafter upon the occurrence of flashes following a predetermined time-out period, said display driver having a control input coupled to said control means and being responsive to said release signal to release to said display means the number counted during the presence of the preceding enable signal and to continue to display that number on termination of the release signal until the next release signal.

15. The advance determining apparatus of claim 13, wherein said control means includes a monostable multivibrator circuit coupled to said photoelectric sensor and being responsive to a sensor signal to produce a timer signal lasting for a predetermined duration, and a pulse shaper responsive to said timer signal to produce the release signal.

16. The advance determining apparatus of claim 15, and further comprising a delay circuit coupled to said monostable multivibrator circuit for producing a blanking signal a predetermined time after inception of the timer signal, said display driver having a blanking input coupled to said delay circuit and being responsive to the blanking signal to blank said display means.

* * * * *